United States Patent [19]

Shimizu et al.

[11] 4,282,415

[45] Aug. 4, 1981

[54] ROTARY PULSE SWITCH

[75] Inventors: Michio Shimizu; Yukio Iwasaki; Tadashi Wagatsuma, all of Furukawa; Osamu Kasai, Miyagi, all of Japan

[73] Assignee: Alps Electric Co., Ltd., Tokyo, Japan

[21] Appl. No.: 144,335

[22] Filed: Apr. 28, 1980

[30] Foreign Application Priority Data

May 2, 1979 [JP] Japan ..... 54-59383[U]

[51] Int. Cl.[3] ..... H01H 19/60; H01H 19/54

[52] U.S. Cl. ..... 200/336; 200/68; 200/77; 200/11 G; 200/153 L

[58] Field of Search ..... 200/77, 11 G, 17 B, 200/11 A, 6 BA, 6 BB, 68, 11 R, 336, 153 L, 176, 153 V

[56] References Cited

U.S. PATENT DOCUMENTS

| | | | |
|---|---|---|---|
| 3,497,643 | 2/1970 | Heath | 200/336 |
| 3,584,164 | 6/1971 | White | 200/11 G |
| 3,975,601 | 8/1976 | Whelan | 200/153 LB |
| 4,038,508 | 7/1977 | Mapelsden | 200/336 |

*Primary Examiner*—Willis Little

*Attorney, Agent, or Firm*—Guy W. Shoup; Gerard F. Dunne

[57] ABSTRACT

A rotary pulse switch for digital tuners or the like comprises a rotor which is provided with a plurality of protrusions spaced at equal intervals on the peripheral edge of one surface thereof and to which an operation rod is fixed. A housing receives the rotor in a rotatable manner and contact members are respectively disposed at right and left ends within the housing. A member slidable rightwards and leftwards is held midway between both the contact members. By rotating the operation rod a predetermined angle clockwise or counterclockwise, the protrusion of the rotor moves the slidable member rightwards or leftwards so as to be able to turn the contact member "on" repeatedly at the right or left end.

4 Claims, 7 Drawing Figures

ROTARY PULSE SWITCH

BACKGROUND OF THE INVENTION

The present invention relates to a rotary switch, and more particularly to a pulse generating switch for use in the switching between channels of a digital tuner, a transceiver or the like. More specifically, it relates to a rotary pulse switch wherein either of two sets of switching circuits is brought into the "on" state when a plunger is rotated a predetermined angle clockwise or counterclockwise.

SUMMARY OF THE INVENTION

An object of the present invention is to provide a rotary pulse switch having two sets of switching circuits, as is especially suitable for a digital tuner.

To this end, the present invention consists in a rotary pulse switch comprising a rotor which is provided with a plurality of protrusions at equal intervals on the peripheral edge of one surface thereof and to which a an operation rod is fixed, and a housing which receives the rotor in a manner to be rotatable. Contact membersare respectively disposed at right and left ends within the housing, and a member slidable rightwards and leftwards is held midway between both the contact members. The operation rod can be rotated a predetermined angle clockwise or counterclockwise, thereby causing the protrusions of the rotor to move the slidable piece rightwards or leftwards so as to turn "on" the contact member at the right or left end.

The above-mentioned and further objects and advantages of the present invention will become apparent from the following description of a preferred embodiment thereof taken with reference to the drawings.

DESCRIPTION OF THE PREFERRED EMBODIMENT

Hereunder, an embodiment of the present invention will be described with reference to the accompanying drawings. Numerals 1 and 2 designate cases or housings molded of a synthetic resin. Numeral 3 designates an operation rod, on which a rotor 4 is supported. Movable contact elements 5 and 7 are formed by punching a metal plate, while fixed contact elements 6 and 8 are similarly formed by punching a metal plate. A slidable member 9 is formed by bending a metal plate. Shown at 10 is a tactile-feedback leaf spring for endowing the turning of the rotor 4 with a tactile feedback.

Figure 1:
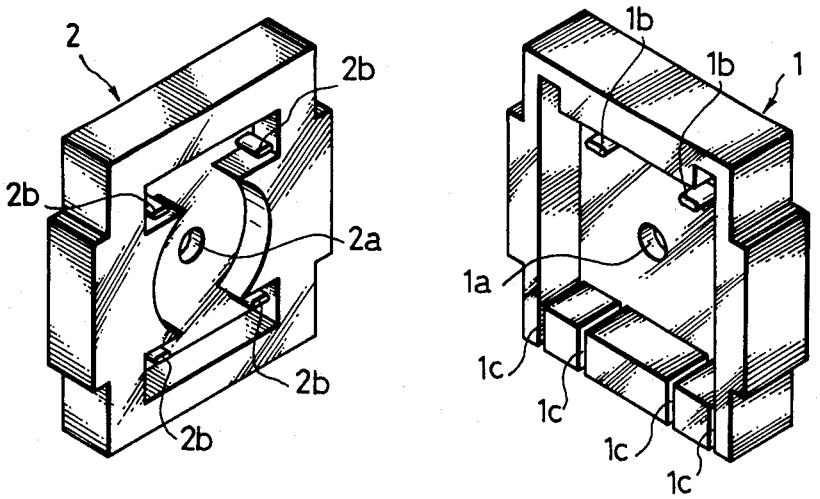
FIG. 1 is a perspective view showing first and second housings of a rotary pulse switch according to the present invention.
Figure 2:
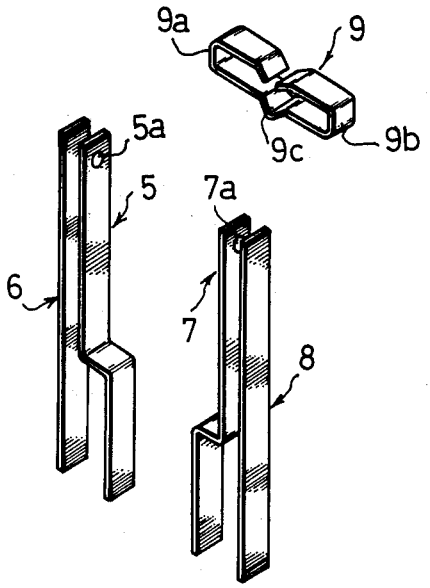
FIG. 2 is a perspective view of a slidable piece, a first contact member and a second contact member in the rotary pulse switch according to the present invention.
Figure 3:
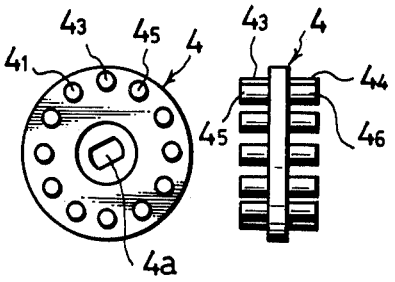
FIG. 3 shows a rotor in the rotary pulse switch according to the present invention, the left side of the figure being a front view of the rotor, the right side being a side view thereof.
Figure 7:
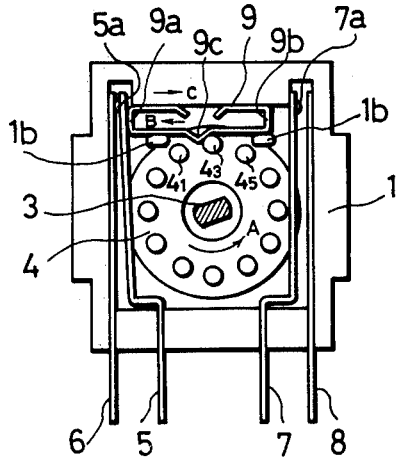
FIG. 7 is a plan view showing the state in which the switch is operating.

The case 1 is centrally provided with a hole 1*a* through which the operation rod 3 is inserted. This case is adapted to arrange the movable contact elements 5 and 7 and the fixed contact elements 6 and 8 on their respective sides of the hole 1*a*, and the slidable piece 9 above the hole 1*a*. More specifically, as shown in FIGS. 1 and 7, projections 1*b* and 1*b* extend from upper parts of the case 1 in order to support the slidable member 9, while grooves 1*c*, are formed in lower parts of the case 1 in order to hold the movable contact elements 5 and 7 and the fixed contact elements 6 and 8 in their proper positions. In a manner similar to the case 1, the case 2 is provided with a hole 2*a* through which the operation rod 3 is inserted. Above and below the hole 2*a*, there are formed projections 2*b*, for holding a tactile-feedback leaf spring 10 above the hole, and another tactile-feedback spring 10 below the hole. The rotor 4 is molded of a synthetic resin, and is centrally provided with a non-circular hole 4*a*. Around the circumference of the rotor 4, a plurality of protrusions $4_1$, $4_2$, etc. extend at equal intervals in the axial direction of the operation rod 3. In this embodiment, the protrusions are disposed on both the surfaces of the rotor 4 as apparent from FIG. 3. The movable contact elements 5 and 7 are respectively formed with contact portions 5*a* and 7*a*, as best seen from FIG. 2, by pressing or the like. The slidable member 9 is situated so that its end parts 9*a* and 9*b* substantially oppose the rear surfaces of the respective contact portions 5*a* and 7*a*. A bulge 9*c* is formed in the central part of the slidable piece 9 as clearly seen in FIG. 2 and is arranged in a position engageable with the protrusions $4_1$, $4_2$, etc. of the rotor 4 as will be described more in detail later.

Figure 4:
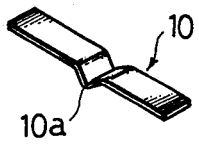
FIG. 4 is a perspective view of a tactile feedback spring in the rotary pulse switch according to the present invention.
Figure 5:
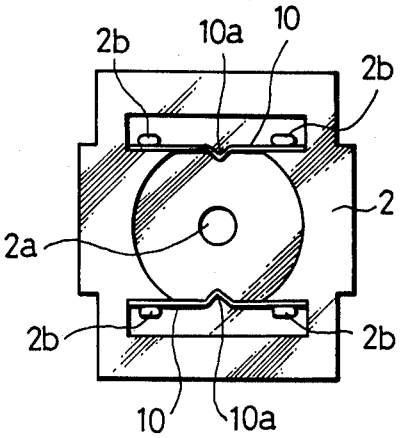
FIG. 5 is a plan view showing the state in which the tactile feedback springs illustrated in FIG. 4 are mounted on the second housing in the rotary pulse switch according to the present invention.
Figure 6:
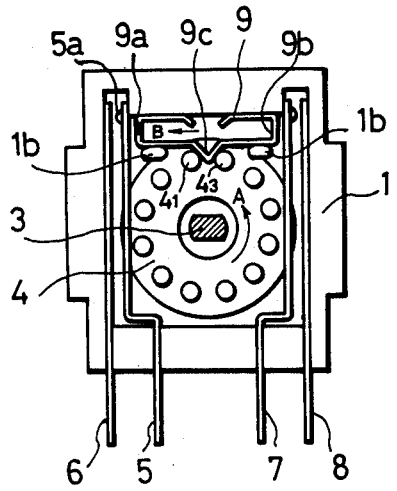
FIG. 6 is a plan view for explaining the operation of the rotary pulse switch according to the present invention, and shows the state before the switch operates.

Now, the operation of the rotary pulse switch of the present invention will be described with reference to FIGS. 6 and 7. When, from under a state illustrated in FIG. 6, the operation rod 3 is turned in the direction of arrow A, the rotor 4 turns simultaneously, and the protrusion $4_3$ of the rotor 4 moves in the direction of arrow A. In this case, the bulge 9*c* of the slidable member 9 lying between the protrusion $4_3$ and the adjacent protrusion $4_1$ is pushed in the direction of arrow B. The slidable member 9 moves in the direction of arrow B, so that the end part 9*a* of the slidable piece 9 abuts against the movable contact element 5 and urges it in the direction of arrow B against its own resilience. Thus, the movable contact element 5 is brought into contact with the fixed contact element 6 so as to turn "on" the switching circuit composed of these contact elements. When the rotor 4 is further turned, the bulge 9*c* is pressed and indented by the protrusion $4_3$ owing to the resilience of the slidable member 9. The protrusion $4_3$ of the rotor 4 passes under the bulge 9*c*, so that the bulge 9*c* comes to lie between the protrusion $4_3$ and the protrusion $4_5$. Thus, the slidable member 9 returns in the direction of arrow C owing to the element of the movable contact piece 5 until the contact between the movable contact element 5 and the fixed contact element 6 is released. The operation rod may then be further rotated to bring the contacts again into engagement. A definite tactile feedback is given to the user by the function of bulges 10*a* (refer to FIGS. 4 and 5) of the tactile-feedback leaf springs 10 as they are engaged with and disengaged from the protrusions $4_2$, $4_4$, etc. formed on the rear side of the rotor 4 simultaneously with the switching operations described above. Although the counterclockwise rotation has been exemplified, the switching in the clockwise rotation can be executed quite similarly.

Now, the assemblage of the rotary pulse switch of the present invention will be described. First, the movable contact element 5 and 7 and the fixed contact elements 6 and 8 are respectively inserted into the grooves 1*c* etc. of the case 1, and the slidable member 9 having the bulge 9*c* is installed between the outer wall of the case 1 and the projections 1*b* thereof. Thereafter, the operation rod 3 is inserted through the hole 1*a* of the case 1, whereupon the rotor 4 is mounted on the operation rod 3. In this case, the rotor 4 is arranged in the case 1 so that the bulge 9*c* of the slidable piece 9 may lie between the protrusions $4_1$ and $4_3$ of the rotor 4 (refer to FIG. 6). Subsequently, a structure in which the tactile-feedback leaf springs 10 and 10 are installed in the case 2 (refer to FIG. 5) is confronted with the case 1, and the operation rod 3 is inserted into the hole 2*a* of the case 2. The case 1 and the case 2 are placed on each other, and are fixed to each other by appropriate means. Then, the assemblage ends.

As set forth above, the rotary pulse switch of the present invention is such that pairs of contact elements are arranged on both the sides of the interspace defined by the side wall of the cases, and that the protrusions of the rotor and the bulge of the slidable piece, both these components being received within the cases, are engaged with and disengaged from each other, whereby when the plunger is turned a predetermined angle clockwise or counterclockwise, either of the two switching circuits can be repeatedly turned "on" and "off". It brings forth such remarkable practical effects that the number of constituent parts is small, that the miniaturization is possible and that the assembling job efficiency is high.

What is claimed is:

1. A rotary pulse switch comprising:

a rotor provided with a plurality of protrusions spaced at equal intervals on a peripheral edge of at least one surface thereof and having an operation rod fixed to a central part thereof;

first and second contact member each consisting of a single fixed contact element and a single movable contact element;

a slidable member made from a spring material and which comes into contact with said movable contact elements in said first and second contact members, said slidable member being formed with a bulge to engage said protrusions of said rotor;

a first housing formed with a recess for receiving said rotor in a rotatable manner, said housing having a hole for rotatably holding said operation rod, holding portions for holding said first and second contact members at a right end and a left end of said housing respectively, and a holding portion for slidably holding said slidable member near free ends of said first and second contact members and in an intermediate position between both these members; and a second housing which abuts on said first housing to close up said recess of said first housing;

whereby when said rotor is rotated clockwise or counterclockwise, a protrusion of said rotor engages the bulge of said slidable member and moves said slidable member rightwards or leftwards so as to cause said slidable piece to turn "on" said first or second contact member.

2. A rotary pulse switch according to claim 1, wherein said rotor is provided with a plurality of protrusions at equal intervals on a peripheral edge of a rear surface thereof.

3. A rotary pulse switch according to claim 2, wherein said second housing is formed with a recess for receiving said rotor.

4. A rotary pulse switch according to claim 3, wherein holding portions which hold tactile-feedback leaf springs to engage the protrusions of said rotor on the rear surface thereof so as to bestow a tactile feedback on the rotation of said rotor are provided near said recess in said second housing.

* * * * *